US007917358B2

(12) United States Patent
Rogers

(10) Patent No.: US 7,917,358 B2
(45) Date of Patent: Mar. 29, 2011

(54) TRANSIENT DETECTION BY POWER WEIGHTED AVERAGE

(75) Inventor: Kevin Christopher Rogers, Albany, CA (US)

(73) Assignee: Apple Inc., Cupertino, CA (US)

( * ) Notice: Subject to any disclaimer, the term of this patent is extended or adjusted under 35 U.S.C. 154(b) by 1577 days.

(21) Appl. No.: 11/240,742

(22) Filed: Sep. 30, 2005

(65) Prior Publication Data

US 2007/0078541 A1 Apr. 5, 2007

(51) Int. Cl.
*G10L 21/02* (2006.01)

(52) U.S. Cl. ..... 704/226; 704/500; 704/501; 381/94.1; 381/94.2

(58) Field of Classification Search ..... 700/94; 704/224, 225, 226, 203, 200.1, 230, 229, 704/500, 501; 341/51, 54, 55; 381/23, 94.1, 381/36, 30, 55, 56, 94.2, 94.5, 94.7
See application file for complete search history.

(56) References Cited

U.S. PATENT DOCUMENTS 5,818,839 A * 10/1998 Sterne et al. ..... 370/391
5,945,932 A * 8/1999 Smith et al. ..... 341/51
7,313,519 B2 * 12/2007 Crockett ..... 704/226
7,353,169 B1 * 4/2008 Goodwin et al. ..... 704/224
7,460,993 B2 * 12/2008 Chen et al. ..... 704/230
2004/0044520 A1 * 3/2004 Chen et al. ..... 704/200.1
2004/0196988 A1 * 10/2004 Moulios et al. ..... 381/119
2007/0140499 A1 * 6/2007 Davis ..... 381/23

OTHER PUBLICATIONS

M. D. Kwong & Roch Lefebvre, Transient Detection of Audio Signals Based on an Adaptive Comb Filter in the Frequency Domain, IEEE publication, 2003, pp. 542-545.*
B. Elder, "Coding of Audio Signals with Overlapping Blick Transform and Adaptive Window Functions". Frequenz, vol. 43, 1989, pp. 252-256 (in German).*
Puckette, Miller, "Phase-locked Vocoder," IEEE , Reprinted from Proceedings, IEEE ASSP Conference on Applications of Signal Processing to Audio and Acoustics (Mohonk, N.Y.) 1995.

* cited by examiner

*Primary Examiner* — Vivian Chin
*Assistant Examiner* — Friedrich Fahnert
(74) *Attorney, Agent, or Firm* — Fish & Richardson P.C.

(57) ABSTRACT

A transient in a digital audio signal can be detected by generating a first set of spectral characteristics associated with a first portion of the digital audio signal and a second set of spectral characteristics associated with a second portion of the digital audio signal, wherein the first and second portions of the digital audio signal partially overlap, comparing values in the first set of spectral characteristics with corresponding values in the second set of spectral characteristics to generate a set of ratios, weighting the set of ratios, and analyzing at least a portion of the weighted set of ratios to detect a transient associated with the first portion of the digital audio signal. Further, an indicator identifying the presence of a detected transient can be output. Additionally, one or more ratios in the set of ratios can be weighted based on amplitude, frequency, or a power function.

17 Claims, 8 Drawing Sheets

TRANSIENT DETECTION BY POWER WEIGHTED AVERAGE

BACKGROUND

The present disclosure relates to digital audio signals, and to systems and methods for detecting the occurrence of transients in digital audio signals.

Digital-based electronic media formats have become widely accepted. The development of faster computer processors, high-density storage media, and efficient compression and encoding algorithms have led to an even more widespread implementation of digital audio media formats in recent years. Digital compact discs (CDs) and digital audio file formats, such as MP3 (MPEG Audio-layer 3) and WAV, are now commonplace. Some of these formats store the digitized audio information in an uncompressed state while others use compression. The ease with which digital audio files can be generated, duplicated, and disseminated also has helped increase their popularity.

Audio information can be detected as an analog signal and represented using an almost infinite number of electrical signal values. An analog audio signal is subject to electrical signal impairments, however, that can negatively affect the quality of the recorded information. Any change to an analog audio signal value can result in a noticeable defect, such as distortion or noise. Because an analog audio signal can be represented using an almost infinite number of electrical signal values, it is also difficult to detect and correct defects. Moreover, the methods of duplicating analog audio signals cannot approach the speed with which digital audio files can be reproduced. These and many other problems associated with analog audio signals can be overcome, without a significant loss of information, simply by digitizing the audio signals.

FIG. 1 presents a portion of an analog audio signal 100. The amplitude of the analog audio signal 100 is shown with respect to the vertical axis 105 and the horizontal axis 110 indicates time. In order to digitize the analog audio signal 100, the waveform 115 is sampled at periodic intervals, such as at a first sample point 120 and a second sample point 125. A sample value representing the amplitude of the waveform 115 is recorded for each sample point. If the sampling rate is less than twice the frequency of the waveform being sampled, the resulting digital signal will be substantially identical to the result obtained by sampling a waveform of a lower frequency. As such, in order to be adequately represented, the waveform 115 must be sampled at a rate greater than twice the highest frequency that is to be included in the reconstructed signal. To ensure that the waveform is free of frequencies higher than one-half of the sampling rate, which is also known as the Nyquist frequency, the audio signal 100 can be filtered prior to sampling. Therefore, in order to preserve as much audible information as possible, the sampling rate should be sufficient to produce a reconstructed waveform that cannot be differentiated from the waveform 115 by the human ear.

The human ear generally cannot detect frequencies greater than 16-20 kHz, so the sampling rate used to create an accurate representation of an acoustic signal should be at least 32 kHz. For example, compact disc quality audio signals are generated using a sampling rate of 44.1 kHz. Once the sample value associated with a sample point has been determined, it can be represented using a fixed number of binary digits, or bits. Encoding the infinite possible values of an analog audio signal using a finite number of binary digits will almost necessarily result in the loss of some information. Because high-quality audio is encoded using up to 24-bits per sample, however, the digitized values closely approximate the original analog values. The digitized values of the samples comprising the audio signal can then be stored using a digital-audio file format.

The acceptance of digital-audio has increased dramatically as the amount of information that is shared electronically has grown. Digital-audio file formats, such as MP3 (MPEG Audio-layer 3) and WAV, that can be transferred between a wide variety of hardware devices are now widely used. In addition to music and soundtracks associated with video information, digital-audio is also being used to store information such as voice-mail messages, audio books, speeches, lectures, and instructions.

The characteristics of digital-audio and the associated file formats also can be used to provide greater functionality in manipulating audio signals than was previously available with analog formats. One such type of manipulation is filtering, which can be used for signal processing operations including removing various types of noise, enhancing certain frequencies, or equalizing a digital audio signal. Another type of manipulation is time stretching, in which the playback duration of a digital audio signal is increased or decreased, either with or without altering the pitch. Time stretching can be used, for example, to increase the playback duration of a signal that is difficult to understand or to decrease the playback duration of a signal so that it can be reviewed in a shortened time period. Compression is yet another type of manipulation, by which the amount of data used to represent a digital audio signal is reduced. Through compression, a digital audio signal can be stored using less memory and transmitted using less bandwidth. Digital audio processing strategies include MP3, AAC (MPEG-2 Advanced Audio Codec), and Dolby Digital AC-3.

Many digital audio processing strategies manipulate the digital audio data in the frequency domain. In performing this processing, the digital audio data can be transformed from the time domain into the frequency domain block by block, each block being comprised of multiple discrete audio samples. By manipulating data in the frequency domain, however, some characteristics of the audio signal can be lost. For example, an audio signal can include a substantial signal change, referred to as a transient, that can be differentiated from a steady-state signal. A transient is typically characterized by a sharp increase and decrease in amplitude that occur over a very short period of time. The signal information representing a transient can be distorted during frequency domain processing, which commonly results in a pre-echo or transient smearing that diminishes the quality of the digital audio signal.

In order to transform a digital audio signal from the time domain, a processing algorithm may convert the blocks of samples into the frequency domain using a Discrete Fourier Transform (DFT), such as the Fast Fourier Transform (FFT). The number of individual samples included in a block defines the time resolution of the transform. Once transformed into the frequency domain, the digital audio signal can be represented using magnitude and phase information, which describe the spectral characteristics of the block. After the window of digital audio data has been processed, and the spectral characteristics of the window have been determined, the digital audio data can be converted back into the time domain using an Inverse Discrete Fourier Transform (IDFT), such as the Inverse Fast Fourier Transform (IFFT).

In order to control pre-echo, some processing algorithms attempt to detecting transient signals in the time domain, before the digital audio data is converted into the frequency domain. If a transient is detected in the time domain, a different, often shorter, block of samples can be identified for frequency domain processing. This does not eliminate the pre-echo but essentially constrains the effect of the pre-echo to the shorter block, which may not be audible. This can be computationally difficult and expensive, as the processing algorithm cannot employ a standard block size. Nonetheless, transients in a digital audio signal ideally should be identified in order to process the signal at a high-quality.

SUMMARY

As discussed above, digital audio signals can be manipulated using a variety of techniques and methods. Many of these techniques and methods rely on transforming the digital audio signal to the frequency domain and consequently distort transient portions of the digital audio signal. In order to minimize these distortions, the present inventor recognized that it was beneficial to accurately detect transients within a digital audio signal.

The present inventor recognized the need to detect transients during frequency domain processing of a digital audio signal. Further, the need to process the digital audio signal to preserve the integrity of a detected transient also is recognized. Accordingly, the techniques and apparatus described here implement algorithms for the accurate and reliable detection of transients in a digital audio signal.

In general, in one aspect, the techniques can be implemented to include generating a first set of spectral characteristics associated with a first portion of the digital audio signal and a second set of spectral characteristics associated with a second portion of the digital audio signal, wherein the first portion of the digital audio signal and the second portion of the digital audio signal partially overlap; comparing values in the first set of spectral characteristics with corresponding values in the second set of spectral characteristics to generate a set of ratios; weighting the set of ratios; and analyzing at least a portion of the weighted set of ratios to detect a transient associated with the first portion of the digital audio signal.

The techniques also can be implemented to include outputting an indicator identifying the presence of a detected transient. Further, the techniques can be implemented such that the indicator comprises a time marker. Additionally, the techniques can be implemented to include calculating a weighted average using one or more ratios included in the weighted set of ratios and comparing the weighted average to a threshold value. The techniques further can be implemented to include calculating the weighted average using one or more ratios included in the weighted set of ratios that correspond to peaks in the first set of spectral characteristics.

The techniques also can be implemented such that weighting further comprises power weighting one or more ratios included in the set of ratios. Further, the techniques can be implemented to such that weighting further comprises weighting one or more ratios included in the set of ratios based on amplitude. Additionally, the techniques can be implemented such that weighting further comprises weighting one or more ratios included in the set of ratios based on frequency. The techniques further can be implemented to include processing the set of ratios, prior to weighting, to isolate a degree of change.

In general, in another aspect, the techniques can be implemented to include machine-readable instructions for detecting a transient in a digital audio signal, the machine-readable instructions being operable to perform operations comprising generating a first set of spectral characteristics associated with a first portion of the digital audio signal and a second set of spectral characteristics associated with a second portion of the digital audio signal, wherein the first portion of the digital audio signal and the second portion of the digital audio signal partially overlap; comparing values in the first set of spectral characteristics with corresponding values in the second set of spectral characteristics to generate a set of ratios; weighting the set of ratios; and analyzing at least a portion of the weighted set of ratios to detect a transient associated with the first portion of the digital audio signal.

The techniques also can be implemented to include machine-readable instructions further operable to perform operations comprising outputting an indicator identifying the presence of a detected transient. Further, the techniques can be implemented such that the indicator comprises a time marker. Additionally, the techniques can be implemented such that the machine-readable instructions for analyzing are further operable to perform operations comprising calculating a weighted average using one or more ratios included in the weighted set of ratios and comparing the weighted average to a threshold value.

The techniques also can be implemented such that the machine-readable instructions for analyzing are further operable to perform operations comprising calculating the weighted average using one or more ratios included in the weighted set of ratios that correspond to peaks in the first set of spectral characteristics. Further, the techniques can be implemented such that the machine-readable instructions for weighting are further operable to perform operations comprising power weighting one or more ratios included in the set of ratios. Additionally, the techniques can be implemented such that the machine-readable instructions for weighting are further operable to perform operations comprising weighting one or more ratios included in the set of ratios based on amplitude.

The techniques also can be implemented such that the machine-readable instructions for weighting are further operable to perform operations comprising weighting one or more ratios included in the set of ratios based on frequency. Additionally, the techniques also can be implemented such that the machine-readable instructions are further operable to perform operations comprising processing the set of ratios, prior to weighting, to isolate a degree of change.

In general, in another aspect, the techniques can be implemented to include processor electronics configured to perform operations comprising generating a first set of spectral characteristics associated with a first portion of the digital audio signal and a second set of spectral characteristics associated with a second portion of the digital audio signal, wherein the first portion of the digital audio signal and the second portion of the digital audio signal partially overlap; comparing values in the first set of spectral characteristics with corresponding values in the second set of spectral characteristics to generate a set of ratios; weighting the set of ratios; and analyzing at least a portion of the weighted set of ratios to detect a transient associated with the first portion of the digital audio signal.

The techniques also can be implemented such that the processor electronics are further configured to output an indicator identifying the presence of a detected transient. Further, the techniques can be implemented such that the processor electronics are further configured to calculate a weighted average using one or more ratios included in the weighted set of ratios and compare the weighted average to a threshold value. Additionally, the techniques can be implemented such that the processor electronics are further configured to calculate the weighted average using one or more ratios included in the weighted set of ratios that correspond to peaks in the first set of spectral characteristics.

The techniques also can be implemented such that the processor electronics are further configured to power weight one or more ratios included in the set of ratios. Additionally, the techniques can be implemented such that the processor electronics are further configured to weight one or more ratios included in the set of ratios based on amplitude.

These general and specific techniques can be implemented using an apparatus, a method, a system, or any combination of an apparatus, methods, and systems. The details of one or more implementations are set forth in the accompanying drawings and the description below. Further features, aspects, and advantages will become apparent from the description, the drawings, and the claims.

BRIEF DESCRIPTION OF THE DRAWINGS

Like reference symbols indicate like elements throughout the specification and drawings.

DETAILED DESCRIPTION

A transient in a digital audio signal can be detected by comparing the spectral characteristics associated with at least two blocks of digital audio data, where the blocks include one or more common samples associated with the digital audio file. A change in the amplitude of the spectral characteristics from the earlier in time portion of the digital audio file to the later in time portion provides an indication that a transient event is occurring.

Figure 1:
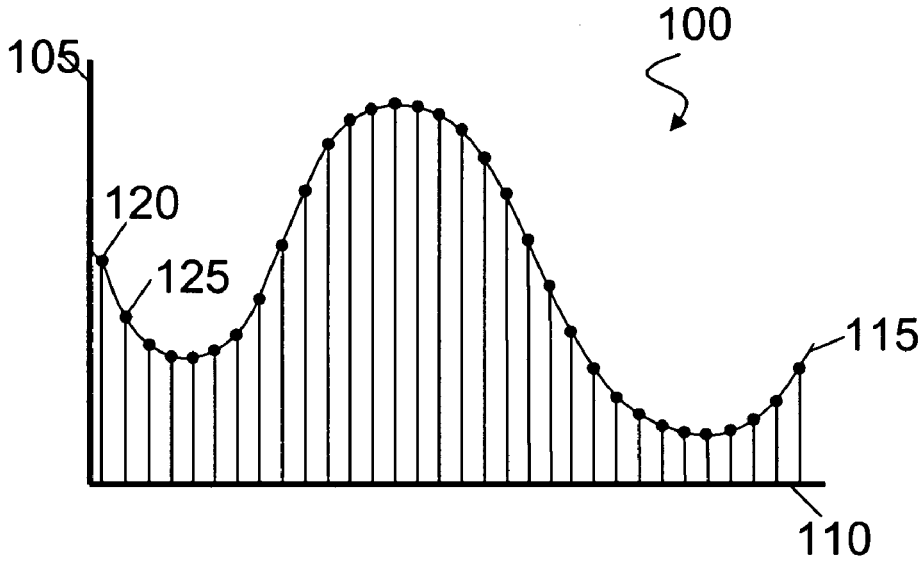
FIG. 1 presents an analog waveform.
Figure 2:
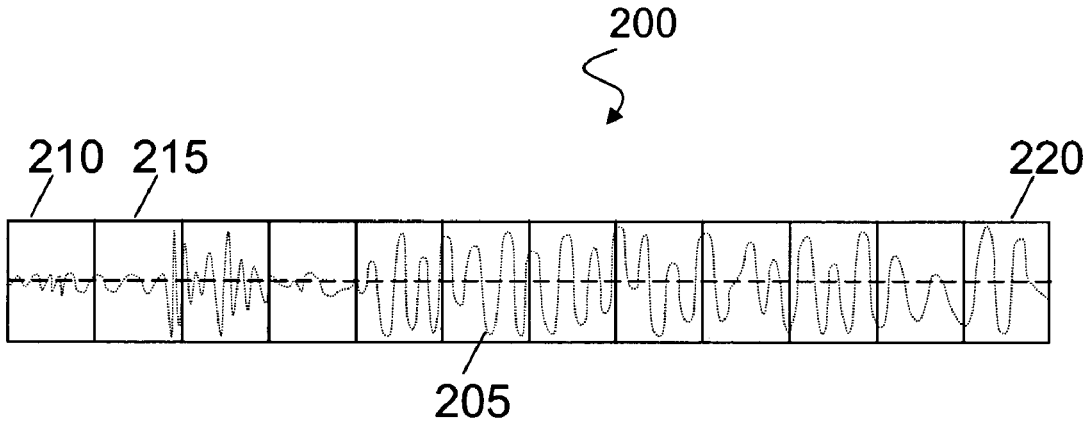
FIG. 2 is a diagram of a digital audio signal.

A Fourier transform can be used to convert a representation of an audio signal in the time domain into a representation of the audio signal in the frequency domain. Because an audio signal that is represented using a digital audio file is comprised of discrete samples instead of a continuous waveform, the conversion into the frequency domain can be performed using a Discrete Fourier Transform algorithm, such as the Fast Fourier Transform (FFT). FIG. 2 shows a digitized audio signal 200, in which the waveform 205 is represented by a plurality of discrete samples or points. The digitized audio signal 200 can be divided into a plurality of blocks, such as a first block 210, a second block 215, and a last block 220. The number of samples included in each block defines the block width. One or more blocks of the digitized audio signal 200, such as the first block 210 and the second block 215, can be transformed from the time domain into the frequency domain to permit processing.

Because one or more of the blocks associated with the digitized audio signal 200 will be transformed using an FFT, the block width can be set to a power of 2 that corresponds to the size of the FFT, such as 512 samples or 1,024 samples. Additionally, if the last block 220 includes fewer samples than are required to form a full block, one or more additional zero-value samples can be added to complete the block. For example, if the FFT size is 1,024 and the last block 220 only includes 998 samples, 26 zero-value samples can be added to fill in the remainder of the block. Other methods also can be used to convert a digital audio signal into the frequency domain, such as a filter-bank or the Modified Discrete Cosine Transform (MDCT).

It is possible to detect a transient in a digitized audio signal during frequency domain processing by comparing the spectral characteristics associated with at least two blocks of digital audio data, where the blocks include a number of common samples of the digitized audio signal and also differ with respect to one or more samples. Changes in the amplitude of the associated spectral characteristics associated from one block to the next can indicate whether a transient event has occurred.

Figure 3:
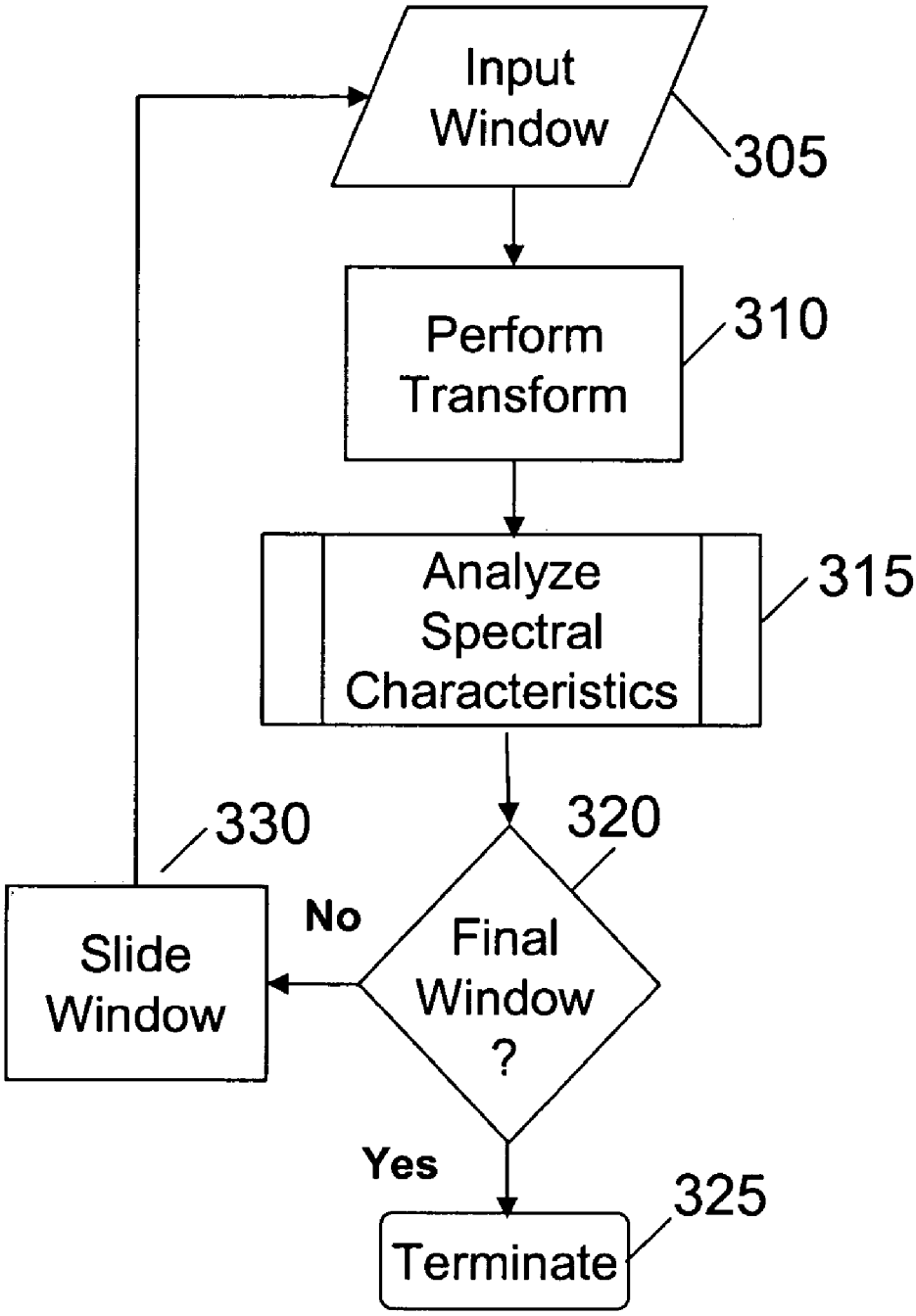
FIG. 3 presents a flowchart for detecting a transient associated with a digital audio signal.

FIG. 3 presents a flowchart describing an implementation for detecting one or more transients in a portion of a digital audio signal. A sliding window can be used to select (305) a block of samples by positioning the sliding window over a portion of the digital audio signal. The samples included in the block defined by the sliding window are designated as input to an FFT. As discussed above, the block width must equal the size of the FFT so that all of the designated samples can be processed. The FFT transforms the designated samples from a time domain representation into a frequency domain representation (310). In performing the transform operation, the audio signal is divided into its component frequencies and the amplitude or intensity associated with each of the component frequencies is determined. The frequency resolution, or number of component frequencies that can be distinguished by the FFT, is equal to one-half of the window size. For example, a 1,024 sample FFT has a frequency resolution of 512 component frequencies or frequency bands. The 512 component frequencies represent a linear division of the frequency spectrum of the audio signal, such as 0 Hz up to the Nyquist frequency.

Once the received samples have been transformed by the FFT (310), the resulting spectral values can be analyzed (315). As described above, the spectral values represent the amplitude or intensity values that are associated with each of the component frequencies. The amplitude or intensity values associated with the current block can be compared with the amplitude of intensity values from a different block, representing a different portion of the digital audio signal. If a transient is detected during the analysis stage (described in detail below), the location of the transient can be stored for use by additional audio processing algorithms.

Further, the digital audio signal is evaluated (320) to determine whether the final block of the digital audio signal has been transformed by the FFT algorithm (310) and analyzed (315). The final block can be automatically identified when the end of the digital audio signal has been reached. Alternatively, a final block can be specified by a user or by an audio processing algorithm. If the final window of the digital audio signal has been transformed and analyzed, the transform operation can be terminated (325). If the final block of the digital audio signal has not been transformed, the input window can be repositioned (330), or slid, along the digital audio signal. The samples associated with the portion of the digital audio signal defined by the repositioned window can then be selected (305) and designated as input to the FFT.

Figure 4A:
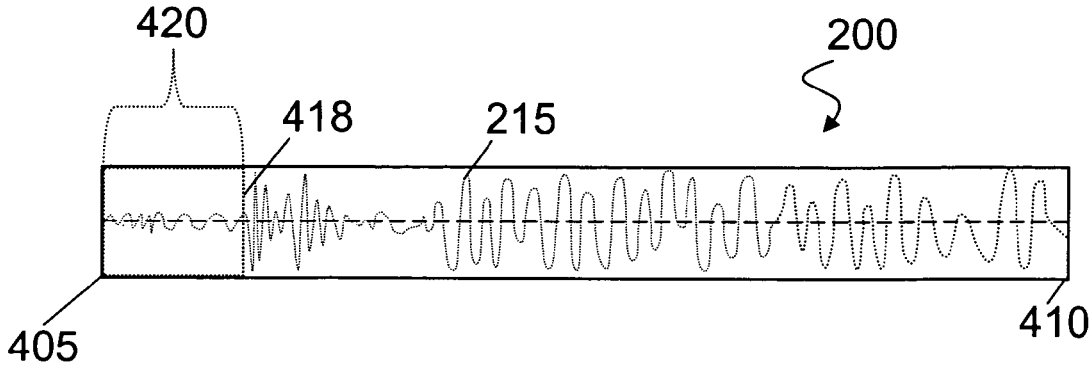
FIGS. 4*a* and 4*b* depict the alignment of a sliding window for a digital audio signal.
Figure 4B:
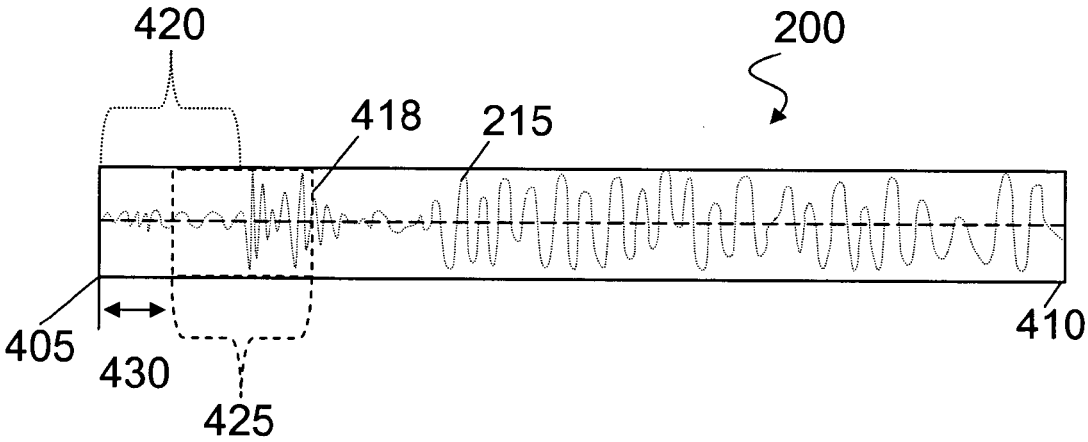

FIGS. 4*a* and 4*b* depict a plurality of alignments of a sliding window applied to a digital audio signal. As described with respect to FIG. 3, a sliding window can be repositioned along the length of the digital audio signal 200. A start time 405 and an end time 410 are associated with the digital audio signal 200, and can be used to determine the duration of the digital audio signal 200. The digital audio signal 200 comprises a waveform 215 that is represented by a plurality of discrete samples, each of which represents an amplitude value. A sliding window 418 can be positioned along the digital audio signal 200 at a first position 420, such that the start of the sliding window 418 is aligned with the beginning of the digital audio signal 200. Alternatively, the sliding window 418 can be positioned at any other point along the digital audio signal 200 at which analysis is to be initiated. The block width represents the number of samples associated with the digital audio signal 200 that occur within the sliding window 418. As a block is defined by the sliding window 418, each block will necessarily include an identical number of samples. Because one or more blocks associated with the digital audio signal 200 will be processed using an FFT, the block width is set to equal a power of 2 that corresponds to the size of the FFT, such as 2,048 samples. In another embodiment, an FFT characterized by a different size can be employed and the block width can be set to equal the size of that FFT. Alternatively, a DFT can be used and the block width can be set to equal any positive integer value. After the sliding window 418 is aligned with the digital audio signal 200 at the first position 420, the samples that occur within the sliding window 418 can be transformed by the FFT (310) and their spectral characteristics can be analyzed (315).

As described above, the sliding window 418 can be repositioned along the length of the digital audio signal 200. FIG. 4*b* shows the first position 420 of the sliding window 418 and the second position 425, which represents the location along the digital audio signal 200 to which the sliding window 418 has been moved. The distance between the start of the first position 420 and the start of the second position 425 is indicated by a sliding window displacement 430. The width of the sliding window displacement 430 represents the number of samples of the waveform 214 that occur between the start of the first position 420 and the start of the second position 425.

The block of samples associated with the sliding window 418 at the first position 420 comprises a portion of the waveform 214 that is also included in the block of samples associated with the sliding window 418 at the second position 425. However, because the sliding window 418 has been repositioned, the block of samples associated with the sliding window 418 at the first position 420 also comprises a portion of the waveform 214 that is not included in the block of samples associated with the sliding window 418 at the second position 425. Further, the block of samples associated with the sliding window 418 at the second position also comprises a portion of the waveform 214 that is not included in the block of samples associated with the sliding window 418 at the first position 420. The number of samples associated with the waveform 214 that are common to the block of samples associated with the sliding window 418 at the first position 420 and the block of samples associated with the sliding window 418 at the second position 425, the overlap between the blocks, can be determined by subtracting the window displacement 430 from the block width. The sliding window displacement 430 can be selected by a user, established by a default setting, stochastically determined, or empirically determined. No matter how the sliding window displacement 430 is determined, however, the amount of displacement should be less than the block width. Otherwise, there will be no overlap between the block of samples associated with the sliding window 418 at the first position 420 and the block of samples associated with the sliding window 418 at the second position 425. If there is no overlap, it will not be possible to detect a transient.

Similarly, the sliding window displacement 430 also indicates the extent to which the block of samples associated with the sliding window 418 at the first position 420 and the block of samples associated with the sliding window 418 at the second position 425 contain unique samples associated with the waveform 214. The number of samples associated with the waveform 214 that are unique to a block determines the time resolution of the comparison between subsequent blocks, which in turn influences the accuracy with which transients can be detected. In other words, the smaller the number of new samples included in each block, the finer the time resolution. Therefore, decreasing the sliding window displacement 430 permits the transients occurring in the digital audio signal 200 to be more precisely identified.

For example, the sliding window displacement 430 can be set to equal one half of the block width. As such, if the block width equals 2048 samples, the sliding window displacement 430 will be 1024 samples. Therefore, the block associated with the sliding window 418 at the first position 420 would include 1024 samples of the waveform 214 that are also included in the block associated with the sliding window 418 at the second position 425, and each block also would contain 1024 samples of the waveform 214 not included in the other block. If greater time resolution is required, a smaller block width and a smaller displacement could be used. For example, the sliding window displacement could be 128 for a block width of 1024 samples.

Figure 5:
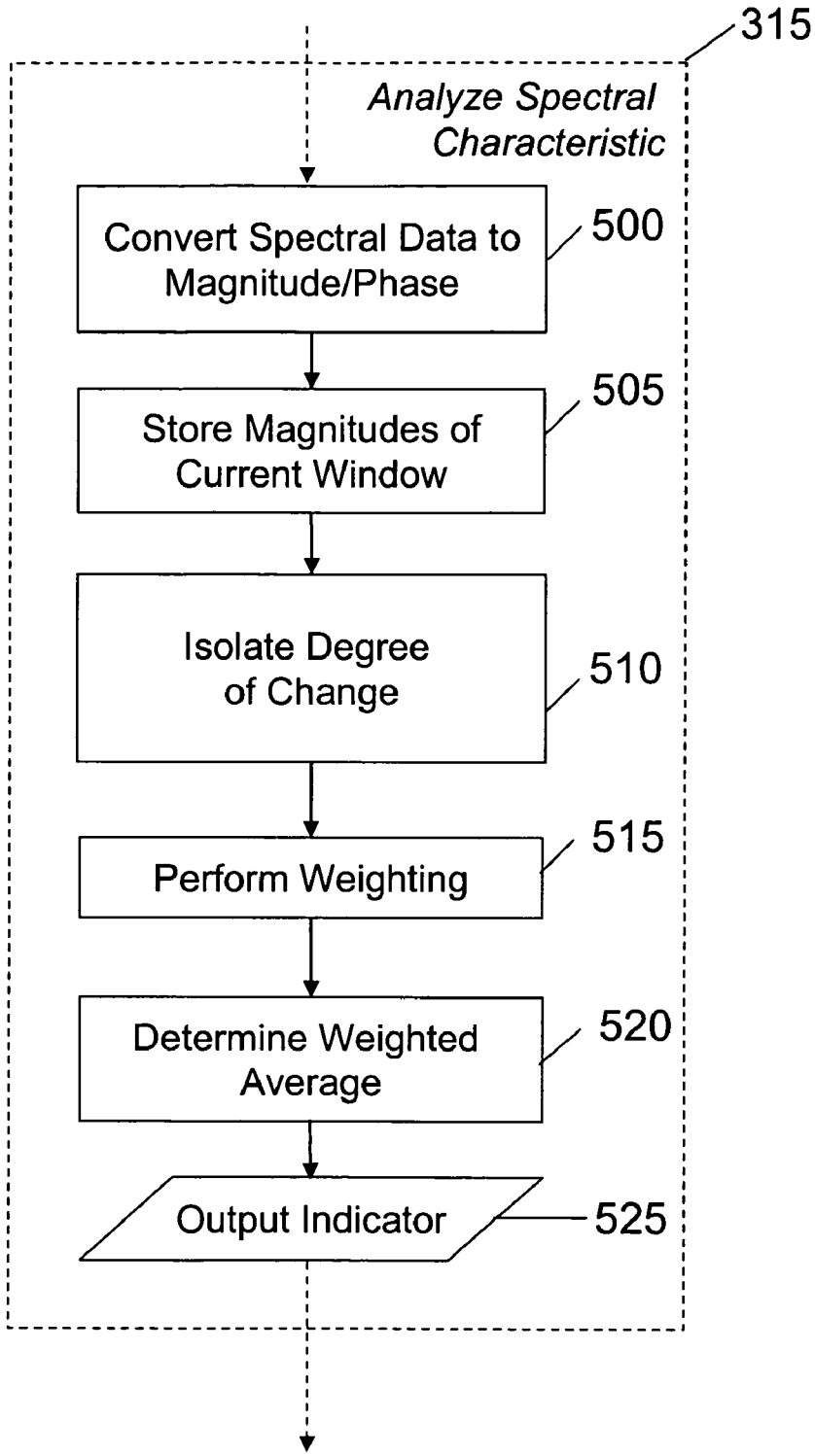
FIG. 5 presents a flowchart for analyzing a window of digital audio data to identify a transient.

FIG. 5 presents a flowchart describing the analysis of spectral characteristics (315) associated with one or more blocks of samples of a digital audio signal. As discussed above, the FFT (310) transforms a block of samples from the time domain into the frequency domain, thereby generating spectral values. The spectral values represent the amplitude or intensity values associated with each of the component frequencies. Each component frequency is represented by a pair of real and imaginary numbers. The component frequencies can be converted to a magnitude and phase representation (500). The magnitude of each component frequency can be expressed as the squareroot(real^2+imaginary^2), where real and imaginary represent the real and imaginary numbers of a component frequency respectively. The phase of each component frequency can be expressed as the arctan(imaginary/real), where real and imaginary represent the real and imaginary numbers of a component frequency respectively. Once determined, the magnitudes of the current window can be stored.

The stored magnitudes associated with two successive blocks can then be compared to determine whether a transient is present in the portion of the digital audio signal associated with those blocks. The magnitude of a component frequency of the current block can be compared with the magnitude of the corresponding component frequency of the previous block to calculate a ratio of the magnitudes for that component frequency (505). The ratio of the magnitudes for a component frequency can be expressed as ratio (j, k)=max(c(j, k)/c(j, k−1), c(j, k−1)/c(j, k)) where c represents the magnitude of the frequency component j associated with the block number represented in terms of k. Therefore, the function ratio (j, k) can be used to detect both sudden increases and sudden decreases in energy. For example, a 1,024 sample FFT has a frequency resolution of 512 component frequencies, so the frequency components range from 1 to 512, and 512 ratios are calculated, one for each component frequency. In an implementation, the ratio corresponding to a component frequency can be processed to further isolate the degree of change that has occurred. For example, a function x can be determined as $x(j, k)=(\text{ratio}(j, k)-1)^2$. In another implementation, the function x can be determined in accordance with a different scaling of the ratio (j, k).

After the function x has been calculated for the ratios of the present block (510), the resulting value of each function x can be individually weighted (515) by a weighting factor. For example, a power weighting can be performed in accordance with the factor weight (j, k)=c(j, k)*c(j, k). Through the use of weighting factors, it is possible to more accurately identify the occurrence of a transient.

In another implementation, the function x can be weighted in accordance with a weighting factor based on amplitude, such as weight (j, k)=c(j, k). In yet another implementation, the weighting factors used to weight the individual component frequencies can be assigned such that they increase linearly from the lowest component frequency to the highest component frequency represented in the spectral characteristics. Alternatively, the weighting factors can be assigned such that they increase in a non-linear fashion to further emphasize the component frequencies in which a transient is sought. Whether linear or non-linear weight factors are employed, the weighting factors can be determined empirically or by an equation.

A final weighted average for the current frame is calculated (520) to determine a degree of difference from the previous frame to the current frame. For example, the weighted average can be determined as weighted_average (k)=Σ(x (j, k)*weight (j, k))/Σ(weight (j, k)), where the summation is over j. Because the component frequencies are weighted prior to the calculation of the final weighted average, the frequency components characterized by a higher magnitude have a greater influence on the average. In an implementation, only the frequency components that represent peaks are included in the calculation of the weighted average. A peak frequency component is defined as a frequency component that has a greater magnitude than both the immediately preceding and the immediately succeeding frequency components. If a component frequency is not bounded on both sides, it can be identified as a peak if the magnitude associated with that component frequency exceeds that of the single neighboring component frequency. In another implementation, all frequency components can be included in the calculation of the weighted average.

The weighted average is then used to determine whether a transient has occurred. The higher the average of the weighted ratios, the more likely it is that a transient is present in the digital audio signal. The user can select a threshold to identify how high the average of the weighted ratios must be in order to determine that a transient is present. Alternatively, a default threshold can be set based on empirical data or analysis-by-synthesis. The threshold selected can be dependent on the time resolution selected. For example, if the time resolution is smaller, the threshold may also be smaller. If a transient is detected (525), an indication is provided to the audio processing algorithm in order to preserve the characteristics of that portion of the audio signal. For example, a time marker can be output to indicate the portion of the digital audio signal in which the transient occurs. In another implementation, the function x calculated for each component frequency can be stored for further use in processing the associated digital audio signal. For example, in processing the current frame, the value x (j, k) can be used in conjunction with the weighted average to determine whether a specific frequency component in the current frame is sinusoidal or transient.

Figure 6A:
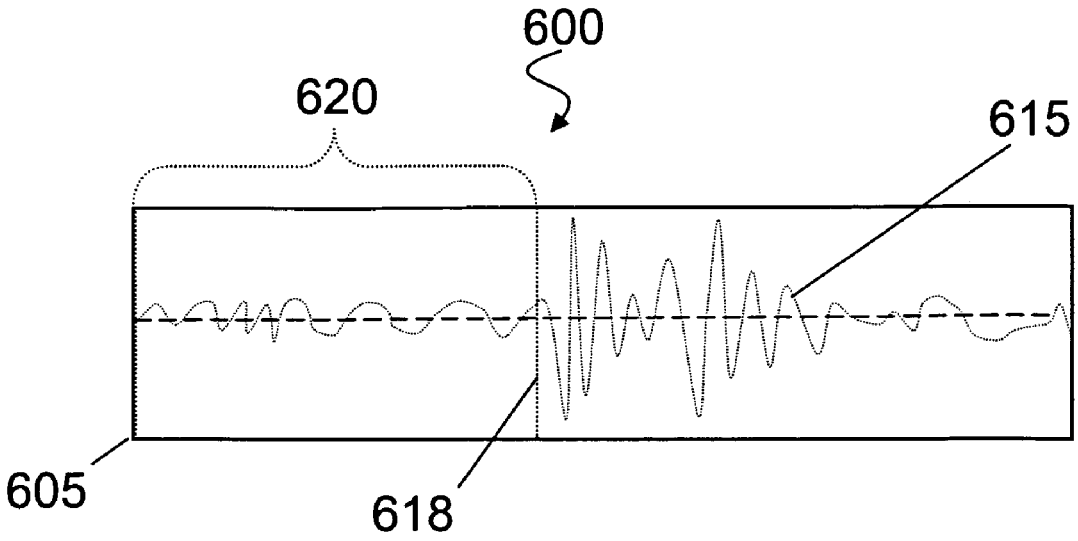
FIGS. 6*a* and 6*b* depict a series of windows applied to a digital audio signal.
Figure 6B:
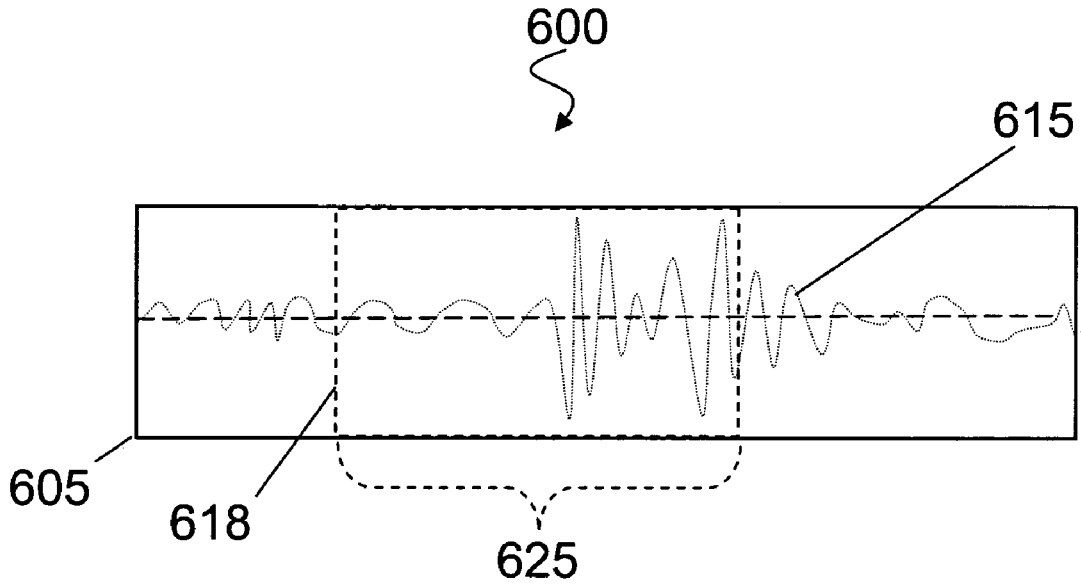

FIGS. 6*a* and 6*b* depict a plurality of alignments of a sliding window applied to a digital audio signal that contains a transient. As described with respect to FIG. 3, a sliding window can be repositioned along the length of a digital audio signal 600. Digital audio signal 600 depicts a portion of digital audio signal 200. A start time 605 is associated with the digital audio signal 600. With respect to FIG. 6*a*, a sliding window 618 can be positioned along the digital audio signal 600 at a first position 620, such that the start of the sliding window 618 is aligned with the beginning of the digital audio signal 600. The portion of the digital audio signal 600 in the sliding window 618 at the first position 620 can be described as having a low amplitude and changing slowly over its duration. As described with respect to FIG. 3, the portion of the digital audio signal 600 in the sliding window 618 at the first position 620 can be transformed to the frequency domain by an FFT (310).

Figure 7A:
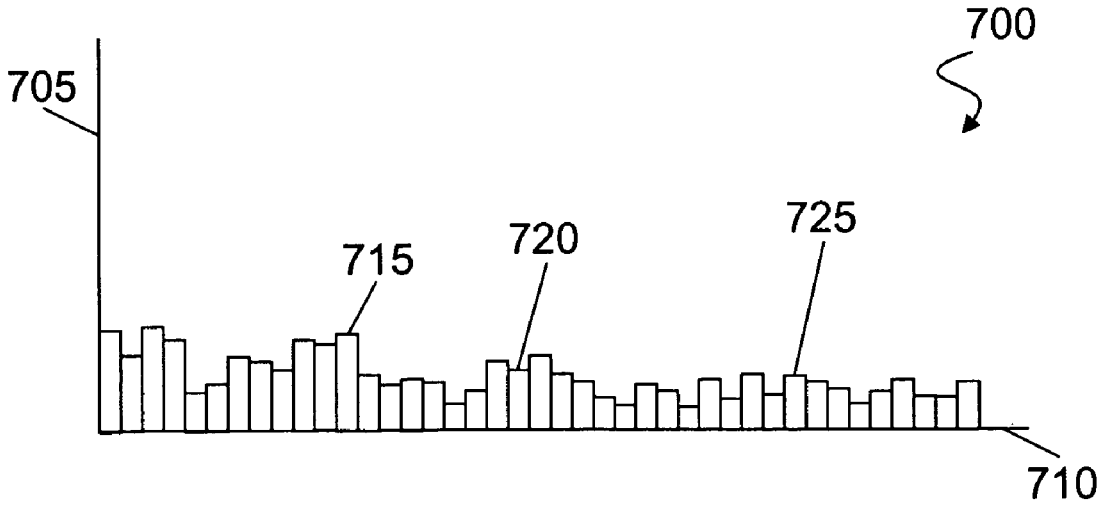
FIGS. 7*a* and 7*b* depict the spectral characteristics associated with a block of digital audio data.
Figure 7B:
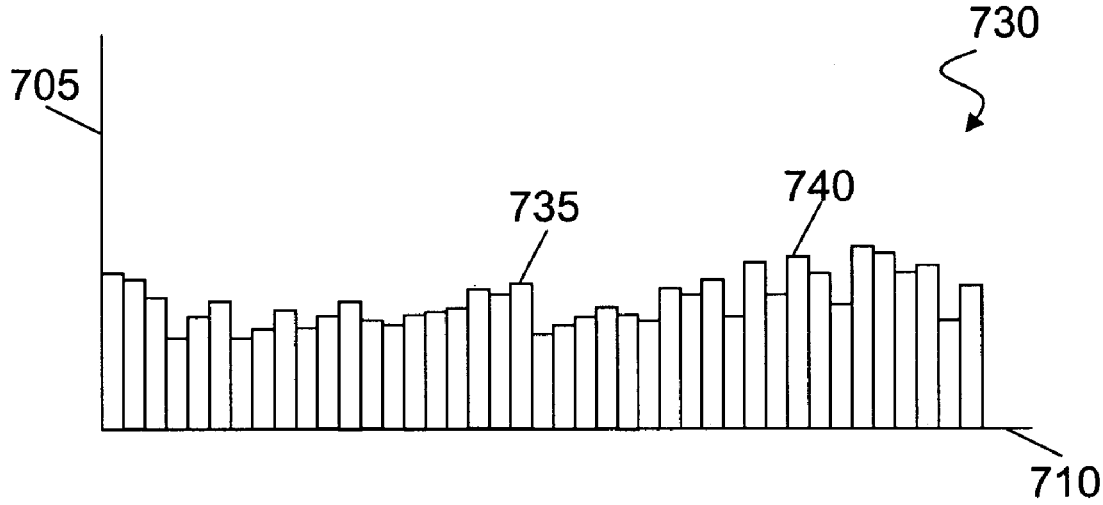

FIGS. 7*a* and 7*b* depict the spectral characteristics associated with the blocks of digital audio data depicted in FIGS. 6*a* and 6*b*. respectively. Specifically, FIG. 7*a* depicts a spectral graph 700 associated with the digital audio signal 600 in the sliding window 618 at the first position 620 in FIG. 6*a*. The spectral graph 700 includes a vertical axis 705, which represents a measure of amplitude or intensity. The spectral graph 700 also includes a horizontal axis 710, which represents a plurality of separate frequencies. Each of the bars, such as the bars 715, 720, and 725 represent the amplitude associated with a particular component frequency. Component frequencies towards the left of the horizontal axis 710, represent lower frequency components, while frequencies towards the right of the horizontal axis 710, represent higher frequency components. As discussed above, the portion of the digital audio signal 600 in the sliding window 618 at the first position 620 can be described as having a low amplitude and changing slowly over its duration. A signal with a low amplitude that changes slowly over its duration generally has low amplitude low frequency spectral components and almost no high frequency spectral components. The lower component frequencies in spectral graph 700 have a low amplitude and the higher frequencies are almost zero. For example, the bar 715, which represents a lower frequency component has a higher amplitude than either bars 720 or 725, which represent midrange and higher frequency components respectively.

As described with respect to FIG. 5, the spectral components displayed in FIG. 7*a*, which represent the portion of the digital audio signal 600 in the sliding window 618 at the first position 620, can be converted to a magnitude and phase representation (500). The magnitudes can be stored (315). The ratio of the magnitude of each component frequency from the current window, the sliding window 618 at the first position 620, to the magnitude of the respective component frequency from the previous window can be calculated for each and every component frequency (505). Where the current window is not preceded by a previous window, such as when the sliding window 618 is at the first position 620, the values associated with the previous window are initialized to zero.

FIG. 6*b* depicts an alignment of a sliding window applied to a portion of the digital audio signal 600 that contains a transient. As described with respect to FIG. 3, the sliding window 618 can be positioned along the digital audio signal 600 at a second position 625. The portion of the digital audio signal 600 in the sliding window 618 at the second position 620 can be described as containing a transient or as having a high amplitude and changing quickly over its duration. As described with respect to FIG. 3, the portion of the digital audio signal 600 in the sliding window 618 at the second position 625 can be transformed to the frequency domain by an FFT (310).

FIG. 7*b* depicts a spectral graph 730 associated with the digital audio signal 600 in the sliding window 618 at the second position 625 in FIG. 6*b*. As described above, a transient is typically characterized by a high amplitude at one or more frequencies and can feature a high amplitude at all frequencies. A visual comparison of FIG. 7*b* to FIG. 7*a* demonstrates that there has been a large increase in the amplitude associated with multiple frequencies, which indicates the potential that a transient event has occurred. For example, the amplitude indicated by the bar 740 is substantially higher than the amplitude indicated by the bar 725.

As described with respect to FIG. 5, the spectral components displayed in FIG. 7*b*, which represent the portion of the digital audio signal 600 in the sliding window 618 at the second position 625, can be converted to a magnitude and phase representation (500). The magnitudes can be stored (315). The ratio of the magnitude of each component frequency from the current window, the sliding window 618 at the second position 625, to the magnitude of the respective component frequency from the previous window, the sliding window 618 at the first position 620, can be calculated for each and every component frequency (505). For example, a ratio can be calculated from bar 740, which represents a component frequency of the sliding window 618 at the second position 625, and bar 725, which represents the same component frequency of the sliding window 618 at the first position 625. As is apparent from the height of bars, 740, and 725, computing the ratio of the component frequency represented by bar 740 to the component frequency represented by bar 725 results in a high number. A high ratio value indicates an increase in the amplitude of the component frequency represented by bars 725 and 740 from the sliding window 618 at the first position 620 to the sliding window 618 at the second position 625.

After the ratios are calculated (505), each ratio can be processed to determine the function x, which can be individually weighted (515) in accordance with a weighting factor, such as the power weighting factor. A visual comparison of FIG. 7*a* to FIG. 7*b* reveals that FIG. 7*b* has a greater amount of high frequency content than FIG. 7*a*. This corresponds to FIG. 6*b*, which contains a transient in the sliding window 618 at the second position 625, and FIG. 6*a*, which contains a steady state signal in the sliding window 618 at the first position 620. By performing the weighting (515), the change in magnitude between the respective current and previous component frequencies is amplified and the occurrence of a transient is more easily detected.

With respect to FIG. 5, a weighted average of the ratios included in a current frame can be calculated (520). If a transient event is detected, an indication of the detected transient is output (525). For example, a time marker can be output to indicate which portion of the digital audio signal contains the detected transient.

Noise also can have a large amount of high frequency content and can thereby result in a false identification of a transient. The effects of noise, however, are greatly reduced by analyzing peak frequency components. Further, the effects of noise can be further reduced by performing weighting in accordance with the magnitude or power of the frequency component. Additionally, a threshold can be used to distinguish between an actual transient and white or pink noise. The threshold value can be determined such that it exceeds the background level changes typically found in noise by a predetermined amount. The threshold value also can be tuned automatically or by a user in response to operation.

Figure 8:
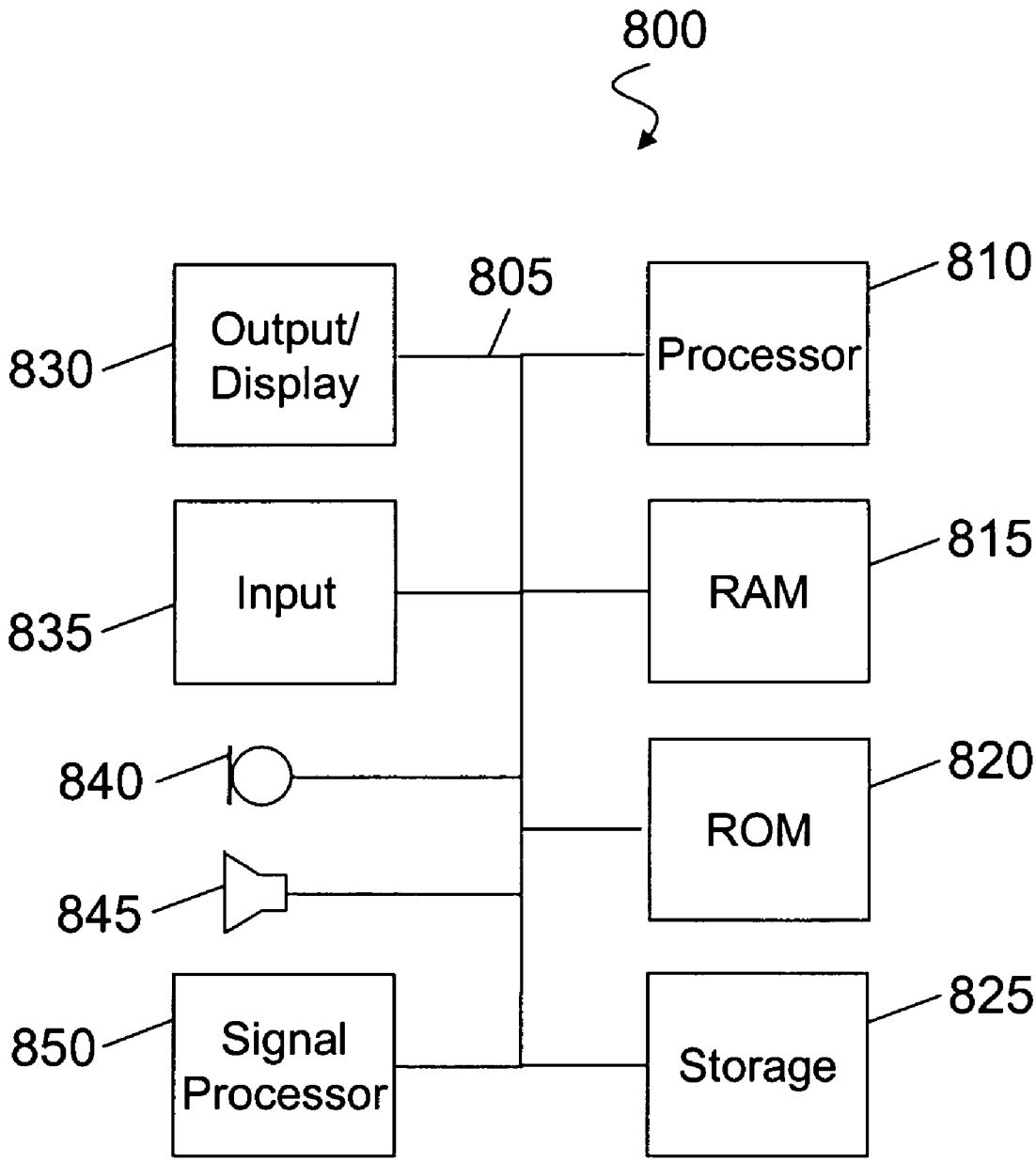
FIG. 8 is a block diagram of a computer system.

FIG. 8 presents a computer system 800 that can be used to implement the techniques described above for processing and playing back a digital audio signal. The computer system 800 includes a microphone 840 for receiving an audio signal. The microphone 840 is coupled to a bus 805 that can be used to transfer the audio signal to one or more additional components. The bus 805 can be comprised of one or more physical busses and permits communication between all of the components included in the computer system 800. A processor 810 can be used to digitize the received audio signal and the resulting digitized audio signal can be transferred to storage 825, such as a hard drive, flash drive, or other readable and writeable medium. Alternately, the digitized audio signal can be stored in a random access memory (RAM) 815.

The digitized audio signals available in the computer system 800 can be displayed along with operations involving the digital audio signals via an output/display device 830, such as a monitor, liquid crystal display panel, printer, or other such output device. An input 835 comprising one or more input devices also can be included to receive instructions and information. For example, the input 835 can include one or more of a mouse, a keyboard, a touch pad, a touch screen, a joystick, a cable interface, and any other such input devices known in the art. Further, audio signals also can be received by the computer system 800 through the input 835. Additionally, a read only memory (ROM) 820 can be included in the computer system 800 for storing information, such as sound processing parameters and instructions.

An audio signal, or any portion thereof, can be processed in the computer system 800 using the processor 810. In addition to digitizing received audio signals, the processor 810 also can be used to perform analysis, editing and playback functions, including the transient detection techniques described above. Further, the audio signal processing functions, including transient detection, also can be performed by a signal processor 850. Thus, the processor 830 and the signal processor 850 can perform any portion of the audio signal processing functions independently or cooperatively. Additionally, the computer system 800 includes an output 845, such as a speaker or an audio interface, through which audio signals can be played back.

Figure 9:
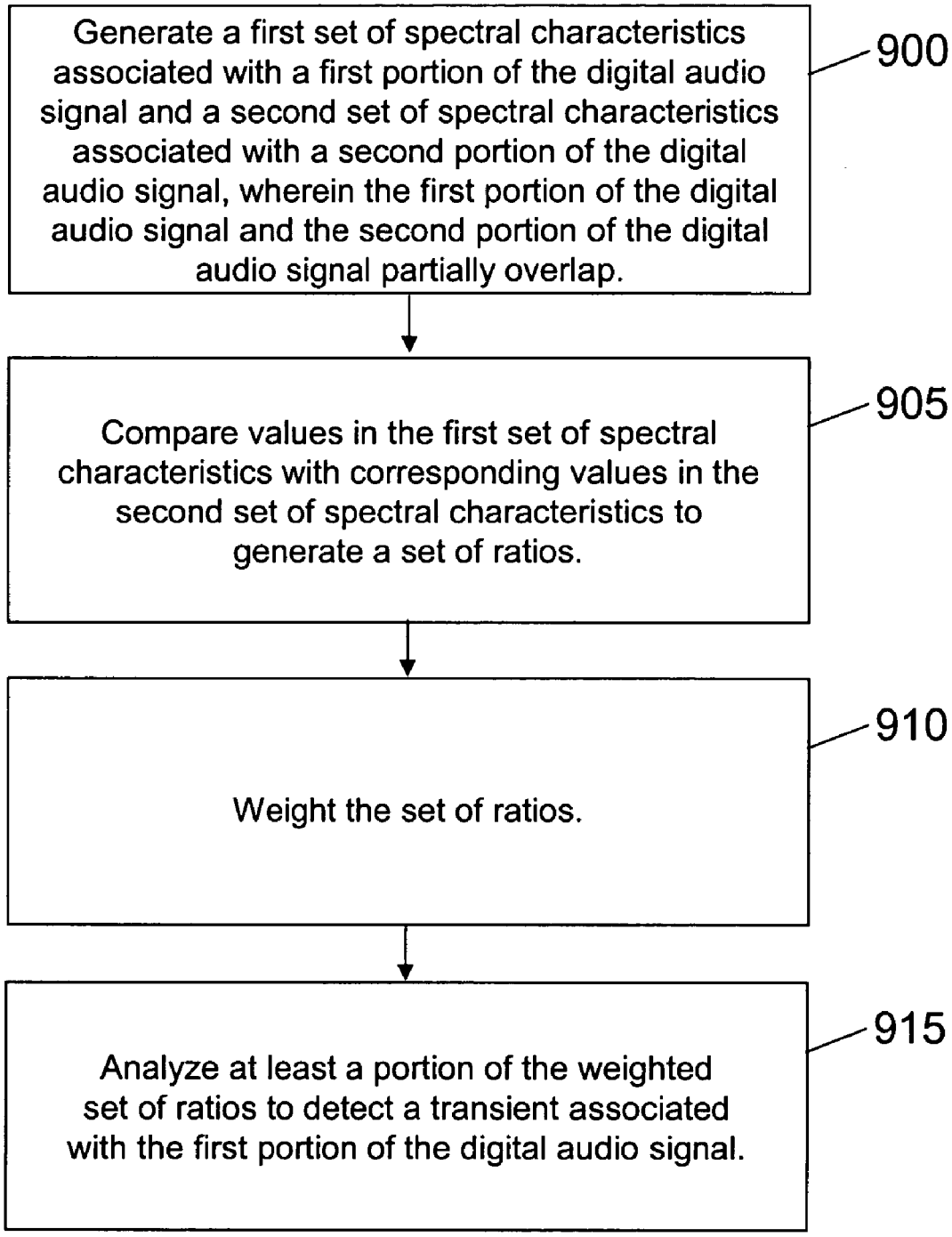
FIG. 9 describes a method of detecting a transient in a digital audio signal.

FIG. 9 describes a method of detecting the occurrence of a transient in a digital audio signal. In a first step 900, a first set of spectral characteristics associated with a first portion of the digital audio signal and a second set of spectral characteristics associated with a second portion of the digital audio signal are generated, wherein the first portion of the digital audio signal and the second portion of the digital audio signal partially overlap. In a second step 905, values in the first set of spectral characteristics are compared with corresponding values in the second set of spectral characteristics to generate a set of ratios. Once the set of ratios has been generated, a third step 910 is to weight the set of ratios. The fourth step 915 is to analyze at least a portion of the weighted set of ratios to detect a transient associated with the first portion of the digital audio signal.

A number of implementations have been disclosed herein. Nevertheless, it will be understood that various modifications may be made without departing from the spirit and scope of the claims. Accordingly, other implementations are within the scope of the following claims.

What is claimed is:

1. A method of detecting a transient in a digital audio signal, the method comprising:

generating a first set of spectral characteristics associated with a first portion of the digital audio signal and a second set of spectral characteristics associated with a second portion of the digital audio signal, wherein the first portion of the digital audio signal and the second portion of the digital audio signal partially overlap;

comparing, for individual component frequencies, a magnitude of a component frequency in the first set of spectral characteristics with a magnitude of a corresponding component frequency in the second set of spectral characteristics to generate a ratio, each generated ratio being included in a set of ratios;

weighting the set of ratios, including calculating, for each ratio in the set of ratios, a function value and applying a weighting factor to the calculated function value; and analyzing at least a portion of the weighted set of ratios to detect a transient associated with the first portion of the digital audio signal.

2. The method of claim 1, further comprising outputting an indicator identifying a portion of the digital audio signal that includes the detected transient.

3. The method of claim 2, wherein the indicator comprises a time marker.

4. The method of claim 1, wherein analyzing further comprises:

calculating a weighted average using one or more ratios included in the weighted set of ratios; and comparing the weighted average to a threshold value.

5. The method of claim 4, further comprising calculating the weighted average using only ratios included in the weighted set of ratios that correspond to peaks in the first set of spectral characteristics.

6. The method of claim 1, wherein weighting further comprises power weighting one or more ratios included in the set of ratios.

7. The method of claim 1, wherein weighting further comprises weighting one or more ratios included in the set of ratios based on amplitude.

8. The method of claim 1, wherein weighting further comprises weighting one or more ratios included in the set of ratios based on frequency.

9. The method of claim 1, further comprising processing the set of ratios, prior to weighting, to isolate a degree of change.

10. A system for detecting a transient in a digital audio signal, the system comprising processor electronics configured to perform operations comprising:

generating a first set of spectral characteristics associated with a first portion of the digital audio signal and a second set of spectral characteristics associated with a second portion of the digital audio signal, wherein the first portion of the digital audio signal and the second portion of the digital audio signal partially overlap;

comparing, for individual component frequencies, a magnitude of a component frequency in the first set of spectral characteristics with a magnitude of a corresponding component frequency in the second set of spectral characteristics to generate a ratio, each generated ratio being included in a set of ratios;

weighting the set of ratios, including calculating, for each ratio in the set of ratios, a function value and applying a weighting factor to the calculated function value; and analyzing at least a portion of the weighted set of ratios to detect a transient associated with the first portion of the digital audio signal.

11. The system of claim 10, wherein the processor electronics are further configured to output an indicator identifying a portion of the digital audio signal that includes the detected transient.

12. The system of claim 10, wherein the processor electronics are further configured to:

calculate a weighted average using one or more ratios included in the weighted set of ratios; and compare the weighted average to a threshold value.

13. The system of claim 12, wherein the processor electronics are further configured to calculate the weighted average using only ratios included in the weighted set of ratios that correspond to peaks in the first set of spectral characteristics.

14. The system of claim 10, wherein the processor electronics are further configured to power weight one or more ratios included in the set of ratios.

15. The system of claim 10, wherein the processor electronics are further configured to weight one or more ratios included in the set of ratios based on amplitude.

16. The method of claim 1, wherein the generated ratio is equal to the magnitude of the component frequency in the first set of spectral characteristics divided by the magnitude of the corresponding component frequency in the second set of spectral characteristics when the magnitude of the component frequency in the first set is larger than the magnitude of the corresponding component frequency in the second set, and equal to the magnitude of the corresponding component frequency in the second set of spectral characteristics divided by the component frequency in the first set of spectral characteristics when the magnitude of the component frequency in the first set is smaller than the magnitude of the component frequency in the second set.

17. The system of claim 10, wherein the generated ratio is equal to the magnitude of the component frequency in the first set of spectral characteristics divided by the magnitude of the corresponding component frequency in the second set of spectral characteristics when the magnitude of the component frequency in the first set is larger than the magnitude of the corresponding component frequency in the second set, and equal to the magnitude of the corresponding component frequency in the second set of spectral characteristics divided by the component frequency in the first set of spectral characteristics when the magnitude of the component frequency in the first set is smaller than the magnitude of the component frequency in the second set.

* * * * *

UNITED STATES PATENT AND TRADEMARK OFFICE

CERTIFICATE OF CORRECTION

PATENT NO. : 7,917,358 B2
APPLICATION NO. : 11/240742
DATED : March 29, 2011
INVENTOR(S) : Kevin Christopher Rogers It is certified that error appears in the above-identified patent and that said Letters Patent is hereby corrected as shown below:

On the title page, in item (56), in column 2, under "Other Publications", line 4, delete "Blick" and insert -- Block --, therefor.

Signed and Sealed this
Twenty-ninth Day of November, 2011

David J. Kappos

David J. Kappos
*Director of the United States Patent and Trademark Office*